US006092925A

United States Patent [19]

Nojiri

[11] Patent Number: 6,092,925

[45] Date of Patent: Jul. 25, 2000

[54] FROST FORMATION DETECTOR

[75] Inventor: Toshiyuki Nojiri, Tokyo, Japan

[73] Assignee: Ishizuka Electronics Corporation, Tokyo, Japan

[21] Appl. No.: 09/117,777

[22] PCT Filed: Aug. 30, 1996

[86] PCT No.: PCT/JP96/02451

§ 371 Date: Aug. 6, 1998

§ 102(e) Date: Aug. 6, 1998

[87] PCT Pub. No.: WO97/29332

PCT Pub. Date: Aug. 14, 1997

[30] Foreign Application Priority Data

Feb. 6, 1996 [JP] Japan ..... 8-020107

[51] Int. Cl.[7] ..... G01N 25/04; G01N 25/14; G01K 1/0008; F25D 21/06

[52] U.S. Cl. ..... 374/16; 374/28; 374/140; 374/149; 374/151; 62/140; 62/156

[58] Field of Search ..... 374/28, 16; 62/140, 62/156; 436/133, 149, 151

[56] References Cited

U.S. PATENT DOCUMENTS

| | | | |
|---|---|---|---|
| 3,383,877 | 5/1968 | Liebermann et al. . | |
| 4,163,327 | 8/1979 | Thompson et al. | 34/5 |
| 4,345,441 | 8/1982 | Hansen | 62/140 |
| 5,052,190 | 10/1991 | Gregory | 62/225 |
| 5,070,935 | 12/1991 | Sitte et al. | 62/320 |
| 5,345,775 | 9/1994 | Ridenour | 62/140 |
| 5,396,777 | 3/1995 | Martin | 62/156 |
| 5,522,232 | 6/1996 | Nojiri | 62/140 |
| 5,707,151 | 1/1998 | Parker et al. | 374/120 |

FOREIGN PATENT DOCUMENTS

| | | |
|---|---|---|
| 36-16687 | 9/1961 | Japan . |
| 51-119047 | 9/1976 | Japan . |

*Primary Examiner*—G. Bradley Bennett
*Assistant Examiner*—Gail Verbitsky
*Attorney, Agent, or Firm*—McDermott, Will & Emery

[57] ABSTRACT

A frost deposition detecting device is provided. This frost deposition detecting device comprises: a base member 1; a heat-conductive container 4 including a frosting portion provided to the base member 1; a thermally sensitive element 6' for detecting the temperature of the base member 1; a protection pipe 8 inserted into the base member 1 and disposed in the cavity formed inside the heat-conductive container; a heat insulator integrally formed with the protection pipe 8 to reduce heat conduction to the protection pipe 8; and another thermally sensitive element 6 secured in the protection pipe 8. With such frost deposition detecting device, highly accurate frost detecting performance and excellent durability in terms of water resistance and humidity resistance can be achieved.

10 Claims, 7 Drawing Sheets

FROST FORMATION DETECTOR

DETAILED DESCRIPTION OF THE INVENTION

1. Field of the Invention

The present invention relates to a frost deposition detecting device having a temperature sensor, and more particularly to a frost deposition detecting device used in an evaporator or a defrosting device of a heat exchanger for various industrial machines and home refrigerators.

2. Related Art

As is well known, the cooling efficiency of a refrigerator is often reduced due to frost deposited on the surface of the cooling fin of an evaporator or a heat exchanger incorporated into it. If cooling operation is continued in the frosted condition, energy consumption will be unnecessarily increased, resulting in high costs and mechanical breakdown. To solve such problem, there has been a method in which defrosting is performed by energizing the heater to raise the temperature of the cooling fin when the total operation time of the compressor in a temporary operation mode reaches a predetermined value, and the heater is switched off after a predetermined period of time has passed since the defrosting operation.

In the conventional defrosting method, the timing to start defrosting can be controlled. However, controlling the timing is not good enough for a defrosting operation, since frosting conditions may vary depending on the ambient temperature, humidity, frequency of opening and closing the door, and the conditions of the content of the refrigerator. As this defrosting method is not for detecting frosting conditions, defrosting may be performed in a non-frosted state, or no defrosting may be performed at all even in an over-frosted state, which by no means increases energy efficiency in the cooling operation.

To eliminate the above problems, the following methods have been developed.

(1) A frost deposition detecting method using an optical means: Light emitted from a light emitting element is reflected from a reflecting surface, and the reflected light is detected by a photodetector. A change in the quantity of light caused by a shift in the refraction index of the light received by the photodetector or the angle of incidence can be detected from the quantity of frost deposited on the reflecting surface. Thus, the deposited frost can also be detected.

(2) A frost deposition detecting method in which a temperature difference is detected: The temperature of the cooling machine or the ambient temperature is detected in a non-frosted condition and a frosted condition. Deposited frost can be detected from the detected temperature difference.

(3) A frost deposition detecting method in which a change in resonance frequency of the piezoelectric vibrator is detected: This method utilizes the face that frost deposited on the surface of a piezoelectric vibrator changes the resonance frequency. If the resonance frequency (the quantity of deposited frost) is larger than a predetermined value, frost deposition is detected.

(4) A microcomputer-controlled frost deposition detecting method: Information on the total operation time of the compressor, frequency of opening and closing of the door, and the outside temperature is inputted into the microcomputer, which judges whether frost exists or not by accumulating the data. Frost deposition can be detected in accordance with a frost deposition detecting program.

However, with the optical frost deposition detecting method (1), it is difficult to keep the frost deposition detector small, and regular maintenance is necessary to maintain a good detection accuracy as the reflection ratio of the reflecting surface. Also, the circuit structure is complicated, resulting in higher cost.

With the method (2) of detecting from a temperature difference, there are many problems in practical use such as low detection accuracy caused by varied quantity of deposited frost. With the method (3) using a piezoelectric vibrator, there is a problem that dust on the vibrator and vibration both from inside and outside often cause erroneous operation. The problem with the microcomputer-controlled method (4) is that the energy consumption efficiency is low due to the varied quantity of deposited frost depending on the season, weather, and other conditions.

In view of this, the present inventor has disclosed, in Japanese Patent Application No. 6-223482 (or U.S. Pat. No. 5,522,232), an inexpensive frost deposition detecting device which requires only simple maintenance and detects frost deposition from a temperature difference. This frost deposition detecting device is not only small and inexpensive, but excellent in detecting performance and reproducibility. FIGS. 8A to 8C illustrate such frost deposition detecting device.

The frost deposition detecting device of FIG. 8A is provided with slit-like openings 23 so that external air can flow into a cavity 22 in a heat-conductive casing 21 made of metal. A thermally sensitive element 24 is disposed inside the cavity 22, and lead wires 24*a* are extended from the casing 21. The thermally sensitive element 24 detects the temperature of the external air flowing into the cavity 22 via the openings 23. When the openings 23 are blocked by deposited frost, the temperature detected by the thermally sensitive element 24 is changed. The frost deposition detecting device of FIG. 8B has the same structure and arrangement for the thermally sensitive element 24 as the frost deposition detecting device of FIG. 8A. A thermally sensitive element 24' for temperature compensation is hermetically contained in the cavity 20 formed inside the casing 21. The frost deposition detecting device of FIG. 8C is provided with the heat-conductive metal casing 21 having two cavities 22 and 22'. One of the cavities has openings 23 which communicate with the outside. The thermally sensitive element 24 for detecting the temperature of the outside is disposed in the cavity 22, and the thermally sensitive element 24' for temperature compensation is disposed inside the other cavity 22'.

In the frost deposition detecting device of FIG. 8A, the openings 23 are open in a non-frosting condition, and the thermally sensitive element 24 disposed inside the cavity detects the outside temperature. If the openings 23 are blocked by deposited frost, the thermally sensitive element 24 detects the temperature of the cooling fin to which the frost deposition detecting device is attached. As there is a temperature difference between before and after the blocking of the openings 23, frost deposition can be detected from the temperature difference. In the frost deposition detecting device of FIG. 8B, besides the thermally sensitive element 24 for detecting outside temperature, a thermally sensitive element 24' for detecting the temperature of the casing 21 is disposed inside the cavity 20. By using the thermally sensitive element 24' for temperature compensation, the frost deposition detecting device of FIG. 8B can detect frost deposition more accurately than the frost deposition detecting device of FIG. 8A.

In the frost deposition detecting device of FIG. 8C, the thermally sensitive elements 24 and 24' are disposed in the equal-sized cavities 22 and 22', respectively, formed inside the casing 21. The thermally sensitive element 24 detects the outside temperature through the openings 23 provided to the cavity 22, while the thermally sensitive element 24' disposed inside the cavity having no openings detects the ambient temperature under no influence of outside air. If the surface of the detector is frosted and the openings 23 are blocked by deposited frost, the thermally sensitive element 24 is not affected by the outside air. As the thermally sensitive elements 24 and 24' disposed in the cavities both detect the ambient temperature of an evaporator to which the frost deposition detecting device is attached, there is no temperature difference. Accordingly, whether there is deposited frost or not can be detected by detecting the time when the temperatures in both cavities become equal (i.e., when the temperature difference becomes zero). In such structure, two thermally sensitive elements are disposed in cavities of the same size, and the resistance of the two thermally sensitive elements changes with the variation of the ambient temperature. Thus, more accurate frost deposition detection can be performed, compared with the prior art shown in FIG. 8A.

Problems to be Solved by the Invention

However, the above frost deposition detecting device has the following drawbacks.

The frost deposition detecting device of FIG. 8 has openings 23 on one side of a casing 21. As a result of repeated frosting and defrosting, the melt water is frozen at the time of re-cooling, and the water remains inside a cavity 22. Accordingly, there is no temperature difference between the cavity 22 on the detecting side and a cavity 22' on the temperature compensation side, and the frost deposition detecting device wrongly judges that it is in a frosted condition, often resulting in inaccurate detection operations.

As the thermally sensitive elements 24 and 24' are exposed inside the cavities 22 and 22', they may deteriorate or be eroded due to drops of water caused at the time of defrosting. As a result, the lead wires 24*a* and 24*a'* are cut off, and the performance of the frost deposition detecting device are lowered, accordingly.

The temperature of the casing 21 of the frost deposition detecting device is cooled to substantially the same temperature as that of the evaporator, to which the frost deposition detecting device is attached. If the heat insulation between the lead wire 24*a* and the hole penetrating through the lead wire 24*a* of the thermally sensitive element 24 is imperfect, the thermally sensitive element 24 is liable to be affected by the temperature of the casing 21, allowing room for more improvement in detection performance.

The present invention is aimed at solving the problems mentioned above and providing a frost deposition detecting device which exhibits great detection performance and has thermally sensitive elements excellent in water resistance and humidity resistance.

Means to Solve the Problems

To achieve the above object, the present invention, in accordance with a first aspect, provides a frost deposition detecting device which comprises: a heat-conductive base member; a first thermally sensitive element for detecting heat from the base member; a frosting portion provided to the base portion; a protection pipe inserted into the base member and disposed adjacent to the frosting portion; a heat insulator integrally formed with the protection pipe; and a second thermally sensitive element for detecting the ambient temperature of the region surrounded by the frosting portion. The second thermally sensitive element is secured in the protection pipe.

The present invention, in accordance with a second aspect, provides a frost deposition detecting device which comprises: a heat-conductive base member; a first thermally sensitive element for detecting the temperature of the base member; a heat-conductive container having a frosting portion provided to the base member; a protection pipe inserted into the base member and disposed in the cavity formed inside the heat-conductive container; a heat insulator integrally formed with the protection pipe; and a second thermally sensitive element for detecting the ambient temperature of the cavity. The second thermally sensitive element is secured in the protection pipe.

The present invention, in accordance with a third aspect, provides a frost deposition detecting device which comprises: a heat-conductive base member; a heat-conductive container having a frosting portion provided to the base member; a cavity formed inside the heat-conductive container; another cavity formed adjacent to the heat-conductive container; protection pipes inserted into the respective cavities; heat insulators integrally formed with the respective protection pipes; and thermally sensitive elements secured in the respective protection pipes.

The present invention, in accordance with a fourth aspect, provides a frost deposition detecting device which comprises: a heat-conductive base member; a first heat-conductive container having a frosting portion provided to the base member; a second heat-conductive container provided to the base member; protection pipes disposed in the cavities formed inside the first and second heat-conductive containers; heat insulators integrally formed with the protection pipes; and thermally sensitive elements secured in the respective protection pipes. The present invention, in accordance with a fifth aspect, provides a frost deposition detecting device which comprises: a heat-conductive base member; and a frosting portion consisting of at least one pillar-like protrusion, a heat-conductive container provided to the base member; a protection pipe disposed adjacent to the frosting portion; another protection pipe secured in the cavity formed inside the heat-conductive container; heat insulators integrally formed with the respective protection pipes; and thermally sensitive elements secured in the respective protection pipes.

The present invention, in accordance with a sixth aspect, provides a frost deposition detecting device characterized in that the base member and the frosting portion or the heat-conductive container having the frosting portion are made of aluminum, copper, iron, nickel, titanium, zinc, or an alloy of any combination of those materials.

The present invention, in accordance with a seventh aspect, provides a frost deposition detecting device characterized in that the heat insulators are formed separately from the protection pipes.

The present invention, in accordance with an eighth aspect, provides a frost deposition detecting device characterized in that at least the frosting portion is coated with a water repellent material or a hydrophilic material.

The present invention, in accordance with a ninth aspect, provides a frost deposition detecting device characterized in that the base member has a contact portion with a pipe of an evaporator.

The present invention, in accordance with a tenth aspect, provides a frost deposition detecting device characterized in that the side surface corresponding to the contact portion formed on the base member is curved or inclined.

EMBODIMENTS OF THE INVENTION

The following is a detailed description of embodiments of the present invention, with reference to the accompanying drawings.

Figure 1A:
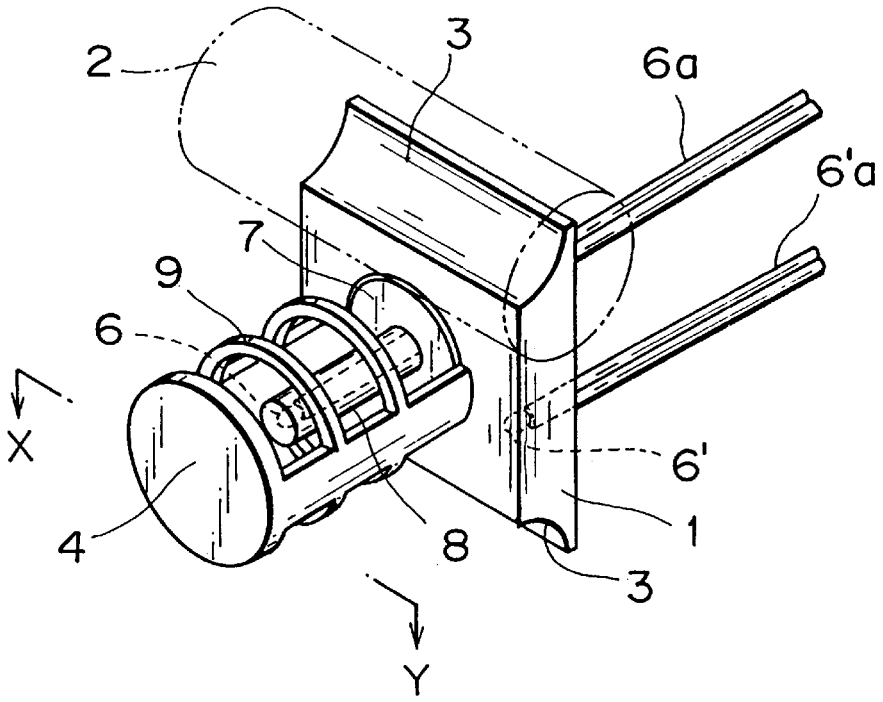
FIG. 1A is a perspective view of one embodiment of a frost deposition detecting device in accordance with the present invention.
Figure 1B:
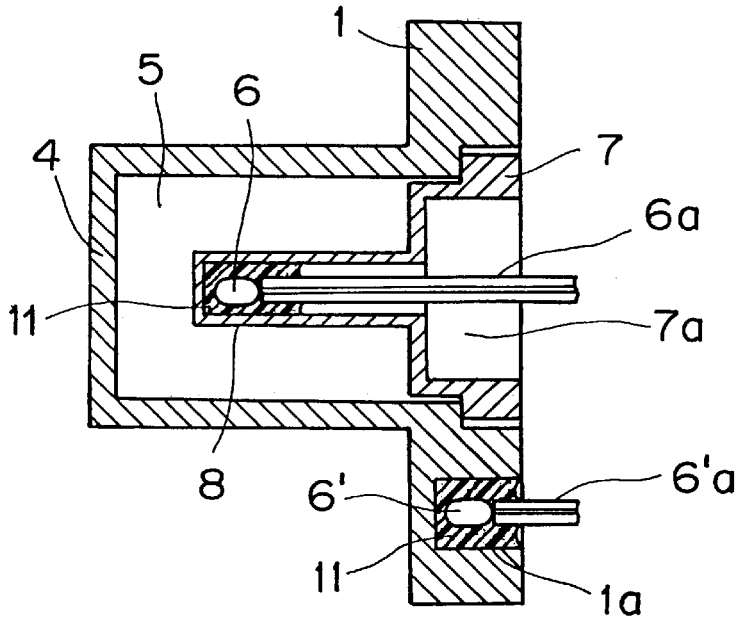
FIG. 1B is a sectional view taken along the line X-Y of FIG. 1A.

FIG. 1A is a perspective view of a frost deposition detecting device of the present invention, and FIG. 1B is a sectional view taken along the line X-Y of FIG. 1A. In the figures, reference numeral 1 indicates a heat-conductive base member made of a metal, such as aluminum, copper, iron, nickel, and titanium. This base member 1 is provided with curved contact portions 3 with which pipes 2 of an evaporator is brought into contact. Reference numeral 4 indicates a heat conductive container having a frosting portion 9 (viz., a structure on which frost can form). The container 4 has slit-like openings through which outside air flows to and from a cavity 5. Inside the cavity 5 is disposed a protection pipe 8 in which a thermally sensitive element 6 for detecting the ambient temperature is secured by an adhesive or resin 11. The protection pipe 8 including the thermally sensitive element 6 is integrally formed with a heat insulator 7 to heat-insulate from the base member 1. The heat insulator 7 is inserted into the base member 1. A concave space 7*a* is formed in the heat insulator 7, and the air within the concave space 7*a* heat-insulates between the base member 1 and the protection pipe 8. The base member 1 has a cavity 1*a* inside so as to detect temperature variation accurately. Another thermally sensitive element 6' of the same characteristics as the thermally sensitive element 6, such as thermistor, is inserted into the cavity 1*a* and hermetically secured by the adhesive or resin 11. Reference numerals 6*a* and 6'*a* indicate lead wires covered with an insulating layer. The thermally sensitive element 6 is inserted into the protection pipe 8 while the thermally sensitive element 6' into the cavity 1*a*. Both thermally sensitive elements 6 and 6' are secured by the resin 11 so as to improve water resistance and moisture resistance.

The frost deposition detecting device of FIG. 1 is attached to a refrigerator such that the contact portions 3 of the base member 1 can be hermetically in contact with the pipes 2 of the evaporator installed in the refrigerator. For instance, the ambient temperature inside the refrigerator is maintained at 10° C., and the surface temperature of the cooling pipes 2 is set at −20° C. As the frost deposition detecting device is yet to be frosted in the initial stage, the outside of the container 4 of the frost deposition detector and the inside of the cavity 5 are open, and the thermally sensitive element 6 inside the cavity 5 is affected by the outside temperature, resulting in detecting a higher temperature than the surface temperature of the evaporator. Meanwhile, the thermally sensitive element 6' hermetically secured inside the base member 1 is cooled with the base member 1 of the frost deposition detecting device in contact with the cooling pipes 2, so as to detect the temperature of the evaporator. This causes a difference between the temperatures detected by the thermally sensitive elements 6 and 6'.

The surface of the frosting portion 9 of the container 4 of the frost deposition detecting device then starts being frosted, and the frost deposited on the surface of frosting portion 9 becomes larger with time, making it difficult for the output air to go through the cavity 5. Finally, the surface of the container 4 is totally covered with deposited frost, and isolates the inside of the cavity 5 from the outside air. As a result, the inner temperature of the cavity 5 becomes equal to the temperature of the evaporator. Accordingly, defrosting can be performed in accordance with the quantity of deposited frost by detecting the temperature difference by the thermally sensitive elements 6 and 6'.

Figure 2A:
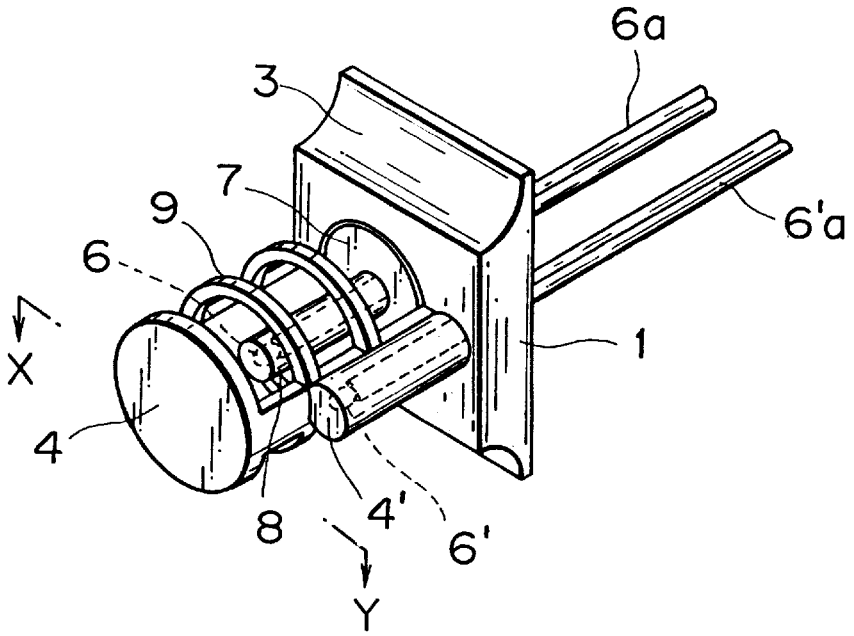
FIG. 2A is a perspective view of another embodiment of a frost deposition detecting device in accordance with the present invention.
Figure 2B:
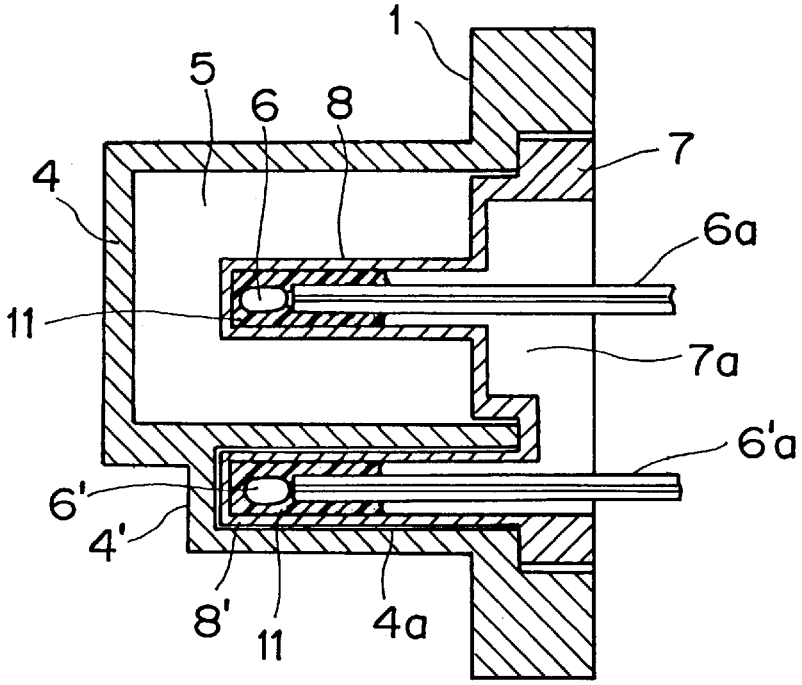
FIG. 2B is a sectional view taken along the line X-Y of FIG. 2A.

The following is a description of an embodiment of the frost deposition detecting device of the present invention, with reference to FIGS. 2A and 2B. FIG. 2A is a perspective view of the frost deposition detecting device, and FIG. 2B is a sectional view taken along the line X-Y of FIG. 2A. The frost deposition detecting device in FIGS. 2A and 2B has heat-conductive containers 4 and 4' on a base member 1. The base member 1 is provided with contact portions 3 to be hermetically in contact with cooling pipes 2. The container 4 is provided with a frosting portion 9, and the container 4' with a cavity portion 4*a*. Outside air flows through the container 4, while no openings for allowing air to flow in are formed on the container 4'. A protection pipe 8 is inserted into the cavity 5 of the container 4, and another protection pipe 8 is inserted into the cavity portion 4*a* of the container 4'. Inside the protection pipe 8, a thermally sensitive element 6 for detecting the ambient temperature is secured by an adhesive or resin 11. Inside the other protection pipe 8', another thermally sensitive element 6' of the same characteristics as the thermally sensitive element 6, such as a thermistor, is inserted and hermetically secured by the adhesive or resin 11. The protection pipe 8 containing the thermally sensitive element 6 is integrally formed with a heat insulator 7 for heat-insulating from the base member 1, and inserted into the base member 1. A concave space 7*a* heat-insulates the protection pipe 8 from the base member 1 by its air layer. Reference numerals 6*a* and 6*a'* indicate lead wires covered with insulating coating.

As the thermally sensitive element 6' is secured in the cavity formed in the base member 1 in FIG. 1, reliability of the frost deposition detecting device is not good enough in terms of water resistance and moisture resistance. In FIG. 2, however, the thermally sensitive elements 6 and 6' disposed in the cavities 5 and 4*a* in the containers 4 and 4' are inserted and secured in the protection pipes 8 and 8' having the heat insulator 7, so as to improve the reliability of the frost deposition detecting device in terms of water resistance and moisture resistance. Also, the thermally sensitive elements 6 and 6' secured in the protection pipes 8 and 8' are easier to be inserted into the container 4 and 4' on the base member 1. As it is possible to select between the thermally sensitive elements 6 and 6' depending on the detected object such as a refrigerator, workability and reliability can be improved. This embodiment also has an advantage that the final check at the time of shipping is not necessary.

Although the thermally sensitive element 6 disposed in the container 4 detects the ambient temperature in the frost deposition detecting device of FIG. 1, the thermally sensitive element 6' disposed on the base member 1 of this embodiment directly detects the temperature of the base member 1, i.e., the temperature of the cooling pipes 2. Accordingly, the difference in heat responsibility caused by the difference in heat capacity of the thermally sensitive elements 6 and 6' might be a detection error due to the temperature difference detecting circuit. With the frost deposition detecting device of FIG. 2, the detection error can be reduced by disposing the thermally sensitive element 6' for temperature compensation in a position separate from the base member 1. However, there remains the difference in heat responsibility. To solve the problem, the thermally sensitive element for frost deposition detection is made to have substantially the same structure as the thermally sensitive element for temperature compensation, so that there is no difference between them in heat responsibility. The following is a description of yet another embodiment of the frost deposition detecting device having such thermally sensitive elements to accurately detect frosting conditions, with reference to FIGS. 3A and 3B.

Figure 3A:
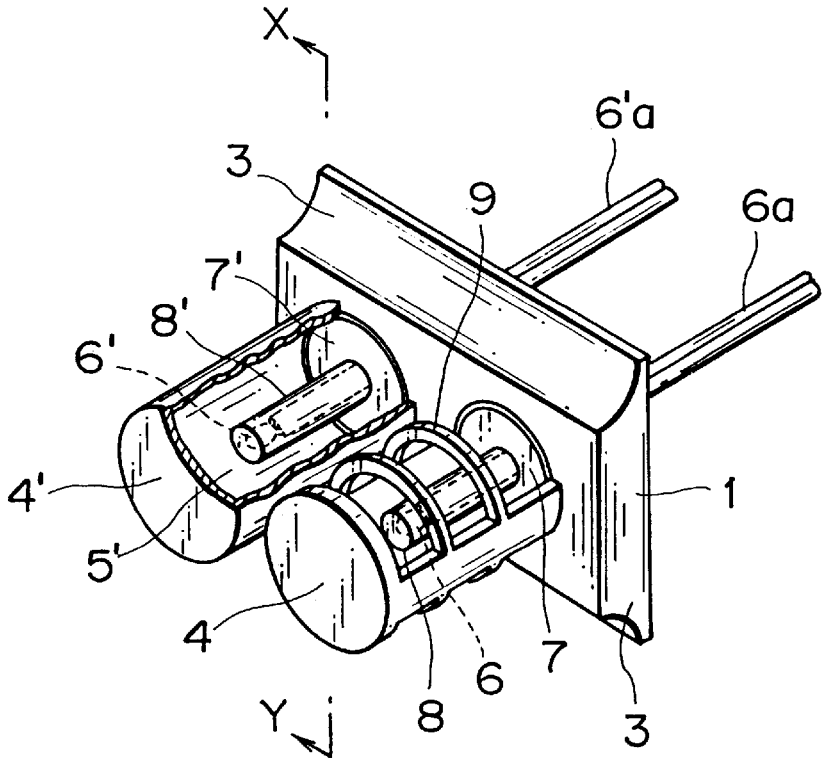
FIG. 3A is a perspective view of yet another embodiment of a frost deposition detecting device in accordance with the present invention.
Figure 3B:
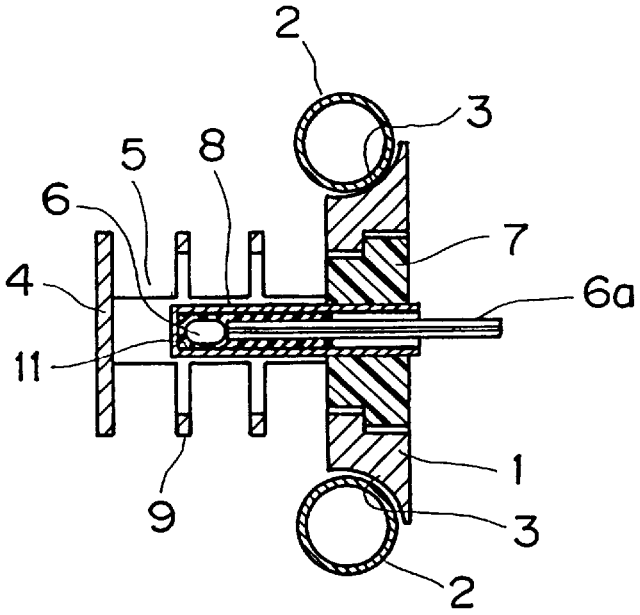
FIG. 3B is a sectional view taken along the line X-Y of FIG. 3A.

FIGS. 3A and 3B illustrate another embodiment of the frost deposition detecting device of the present invention. FIG. 3A is a perspective view of the frost deposition detecting device, and FIG. 3B is a partially cutaway sectional view taken along the line X-Y of FIG. 3A. The frost deposition detecting device of FIG. 3B is attached to a cooling pipe.

In FIGS. 3A and 3B, a heat-conductive base member 1 is provided with contact portions 3 to be hermetically secured to the cooling pipes 2, and heat-conductive containers 4 and 4' are formed on the heat-conductive base member 1. The container 4 is provided with a frosting portion 9, and a thermally sensitive element 6 is disposed in the cavity 5 of the container 4. Slit-like openings are formed on the container 4, and the outside air flows through the slit-like openings. A heat insulator 7 is engaged with the base member 1, and a thermally sensitive element 6 is secured by an adhesive or resin 11 inside the protection pipe 8 in which the heat insulator 7 is disposed. The protection pipe 8 is heat-insulated from the base member 1 by virtue of the heat insulator 7. Meanwhile, a thermally sensitive element 6' for detecting the ambient temperature is disposed in the container 4' having a cavity 5', and a protection pipe 8' provided with the thermally sensitive element 6' is heat-insulated from the base member 1 by virtue of a heat insulator 7'. The base member 1 is hermetically in contact with the cooling pipes 2 so as to be kept at a low temperature. Accordingly, the inner temperature of the cavity 5' is insulated from the external air, and maintained at the same temperature as the evaporator. The protection pipes 8 and 8' through which the heat insulators 7 and 7' penetrate are inserted into the base member 1. The thermally sensitive element 6' disposed inside the container 4' detects the ambient temperature of the evaporator, while the thermally sensitive element 6 detects the external temperature. The thermally sensitive elements 6 and 6' have the same characteristics, each being made of an element such as a thermistor. The containers 4 and 4' are preferably made of the same material so as to equalize the heat capacities.

The frost detecting operation of this embodiment is as follows.

The inner temperature of the refrigerator is maintained at approximately 10° C., and the surface temperature of the cooling pipe at −20° C., for instance. As the frost deposition detecting device is yet to be frosted in the initial stage, the outside of the container 4 of the frost detector and the inside of the cavity 5 are open, and the thermally sensitive element 6 inside the cavity 5 is affected by the outside temperature, resulting in detecting a higher temperature than the surface temperature of the evaporator. Meanwhile, the thermally sensitive element 6' hermetically secured inside the cavity 5' of the container 4' is cooled with the base member 1 of the frost deposition detecting device in contact with the cooling pipes 2, so as to detect the temperature of the evaporator. This causes a difference between the temperatures detected by the thermally sensitive elements 6 and 6'.

The surface of the frosting portion 9 of the container 4 of the frost deposition detecting device then starts being frosted, and the frost on the surface of frosting portion 9 becomes larger with time, making it difficult for the output air to flow through the cavity 5. Finally, the surface of the container 4 is totally covered with frost, and isolates the inside of the cavity 5 from the outside air. As a result, the inner temperature of the cavity 5 becomes equal to the temperature of the evaporator. Thus, defrosting can be performed in accordance with the quantity of deposited frost by detecting the temperature difference by the thermally sensitive elements 6 and 6'.

Figure 4:
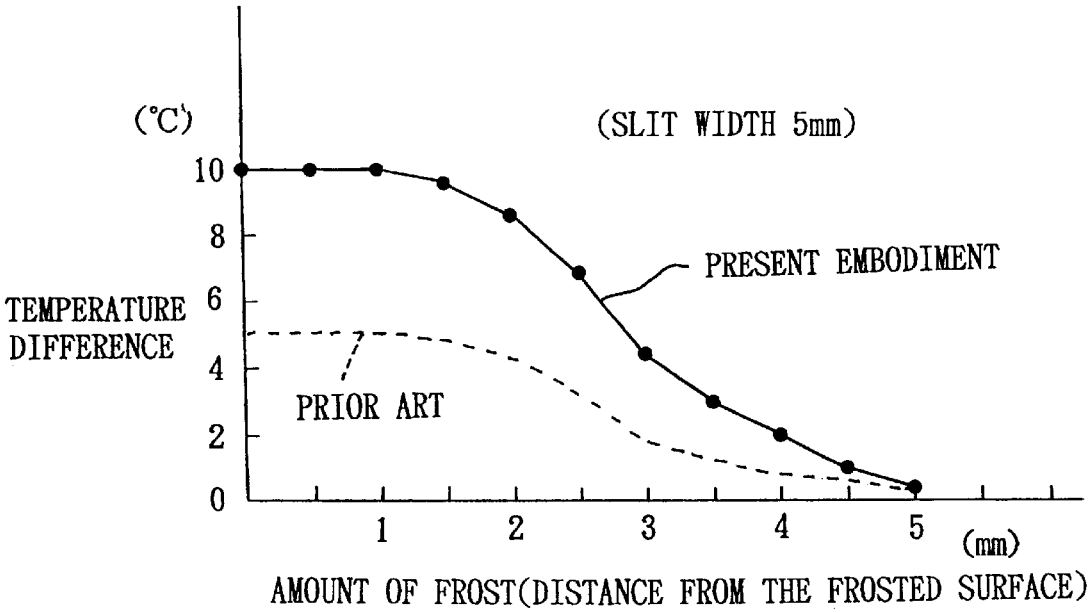
FIG. 4 shows the characteristics of the frost deposition detecting devices of the present invention and the prior art, respectively.

The following is a description of detection characteristics of the frost deposition detecting device of FIG. 4.

Figure 8A:
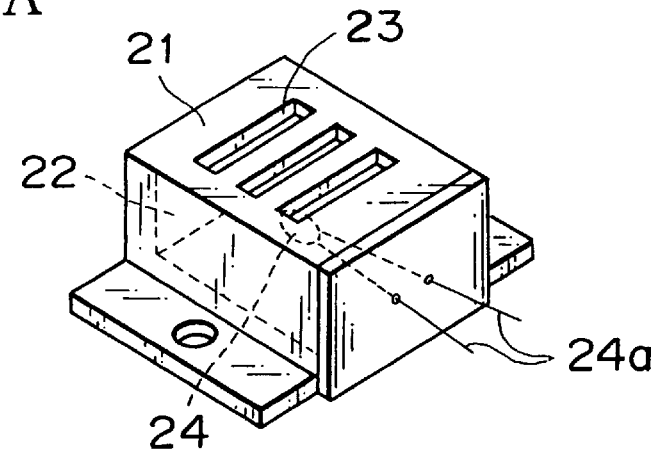
FIG. 8A PRIOR ART
FIGS. 8A to 8C show a frost deposition detecting device of the prior art.
Figure 8B:
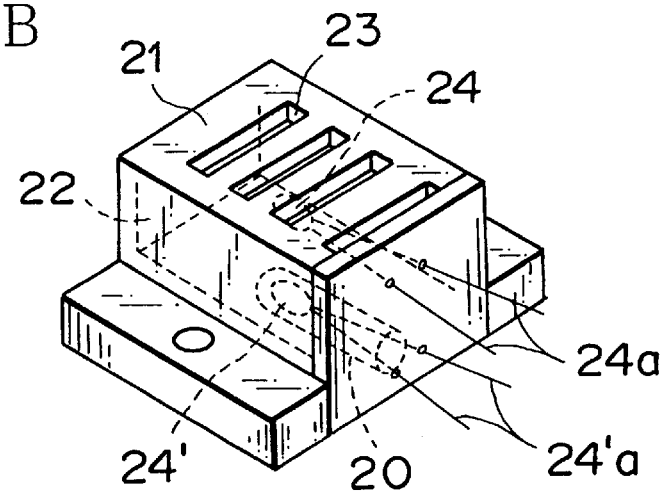
FIG. 8B PRIOR ART
Figure 8C:
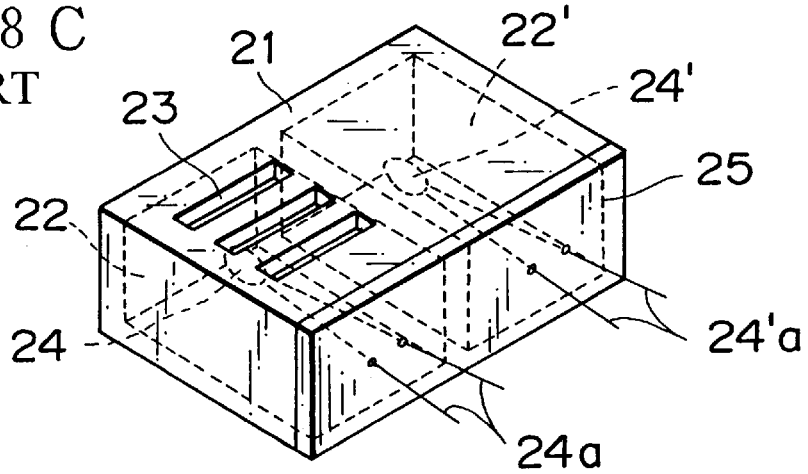
FIG. 8C PRIOR ART

FIG. 4 shows the comparison result between the frost deposition detecting devices of this embodiment (shown in FIGS. 3A and 3B) and the prior art (shown in FIGS. 8A to 8C) in terms of detection characteristics. In the comparison test, the slit width of each frosting portion of the frost deposition detecting devices of this embodiment and the prior art is 5 mm. The result of this comparison test shows that there is a temperature difference of 10° C. in the frost deposition detecting device of this embodiment in a non-frosted state, while there is a temperature difference of 5° C. in the frost deposition detecting device of the prior art.

As can be seen from FIG. 4, there is no difference between the ambient temperatures detected by the thermally sensitive elements 6 and 6' disposed inside the cavities 5 and 5', respectively, because there is no hindrance between the cavity 5 and the external air even if the frosting portion 9 is frosted. Thus, there remains the temperature difference of 10° C. However, the frost on the surface of the frosting portion 9 becomes larger with time, reducing the opening area between the cavity 5 and the outside. Accordingly, the external air gradually stops flowing into the cavity 5, and the temperature difference between the cavities 5 and 5'. Furthermore, as the slit-like openings are shut due to the increasing frost, the cavity 5 becomes isolated from the outside air. The inner temperature of the cavity 5 becomes equal to the temperature of the evaporator (which is substantially equal to the temperature of the base member 1), so no temperature difference inside the containers 4 and 4' is detected by the thermally sensitive elements 6 and 6'.

The temperature difference between the frost deposition detecting devices of this embodiment and the prior art is due to the heat insulating structures of the thermally sensitive element 6 and the base member 1 of this embodiment. In other words, the temperature difference is caused by the insulating structure consisting of the heat insulator 7 and the concave space 7*a*.

In the embodiment shown in FIG. 3, the quantity of deposited frost can be detected from the inner temperature difference between the cavities 5 and 5'. As being apparent from FIG. 4, the temperature difference is larger, and the detecting sensitivity is better in this embodiment than in the prior art. Although the frost on the frosting portion 9 starts growing from both sides, the frost shown in FIG. 4 grows from one side, and the intervals between the slits of the frosting portion 9 are made 5 mm.

In this embodiment, the heat-conductive base member 1 and the heat-conductive container 4 are made of aluminum, copper, iron, nickel, titanium, zinc, or an alloy of the combination of those materials. It may also be made of aluminum nitride, silicon carbide, or the combination of the two.

The base member 1 and the container 4 can be made of a heat-conductive ceramic material such as zinc, silicon, aluminum nitride, and silicon carbide, or a resin material such as carbon fiber impregnate with epoxy resin, or the combination of those heat-conductive materials.

Although the base member 1 and the container 4 and/or the container 4' are integrally shown in this embodiment, the base member 1 can be formed separately from the container 4 and/or the container 4'. The base member 1 and the container 4 and/or the container 4' are formed by a conventional technique such as die casting, cutting, and casting.

In this embodiment, the boundary between the base member 1 and the container 4 is closed so as to prevent water from staying in the container 4. Thus, the water that appears at the time of defrosting can be discharged from the container 4 along the surface of the base member 1.

Although thermistor elements are used as thermally sensitive elements, it should be understood that other elements may also be employed.

Furthermore, the frost deposition detecting device of this embodiment is attached to a cooling pipe, it may also be attached to a cooling fin, for instance.

The frost deposition detecting device of this embodiment is provided with the thermally sensitive elements for temperature compensation, and the surface temperature of the evaporator varies due to the repetition of switching on and off of the evaporator and turbulence of outside air. Thus, it is possible to accurately detect the quantity of deposited frost after temperature compensation by detecting the surface temperature by the thermally sensitive element 6' disposed inside the cavity 5'.

In the embodiments described earlier, the heat insulator 7 and the protection pipe 8 are integrally formed in FIGS. 1 and 2, while they are separately formed in FIG. 3. However, the heat insulator 7 and the protection pipe 8 or 8' may also be separately formed in the embodiments of FIGS. 1 and 2 for better assembling workability and heat responsibility.

Figure 5:
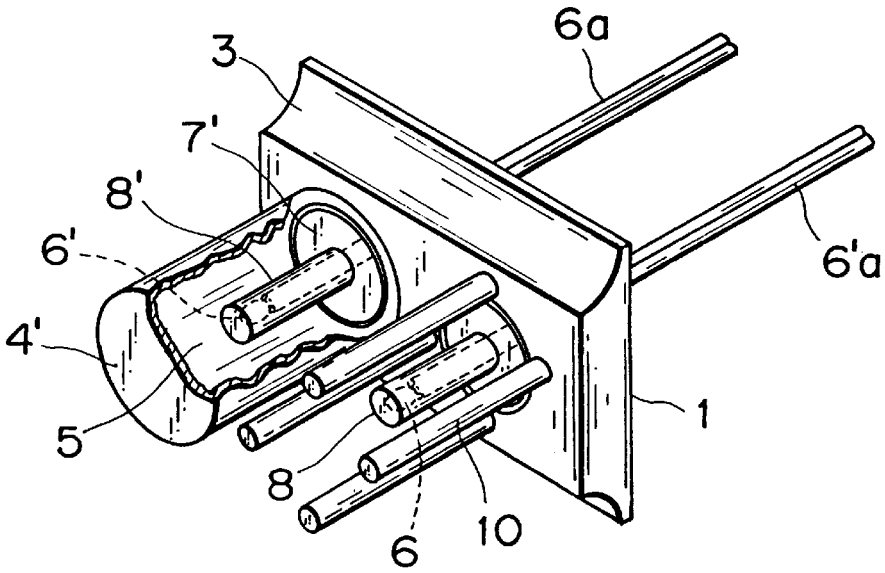
FIG. 5 shows still another embodiment of the frost deposition detecting device in accordance with the present invention.

The following is a description of yet another embodiment of the present invention, with reference to FIG. 5.

Unlike the frost deposition detecting device of FIG. 3 with the slit-like frosting portion, the frost deposition detecting device of FIG. 5 has a container 4 formed by pillar-like frosting portions 10. A thermally sensitive element 6 contained in a protection pipe 8 is disposed in the center surrounded by the pillar-like frosting portions 10. Other features are the same as in the embodiment shown in FIG. 3.

In FIG. 5, frost deposited on the surfaces of the frosting portions 10 becomes larger and prevents the outside air from flowing into the inside space surrounded by the frosting portions 10, so that the inside space can be totally isolated from the outside air. Thus, the temperature difference between the temperature compensating thermally sensitive element 6' and the thermally sensitive element 6 becomes zero, allowing accurate detection of the quantity of deposited frost.

To adjust the quantity of deposited frost, the number of the pillar-like frosting portions 10 is reduced, or the intervals between the frosting portions 10 are changed. Although not shown in the drawings, the frosting portion 10 may also be formed by pillar-like frosting members extending from one pillar, the frosting members surrounding the protection pipe 8. And it is also possible to form the frosting portion 10 by one pillar and dispose it adjacent to the protection pipe 8.

Figure 6A:
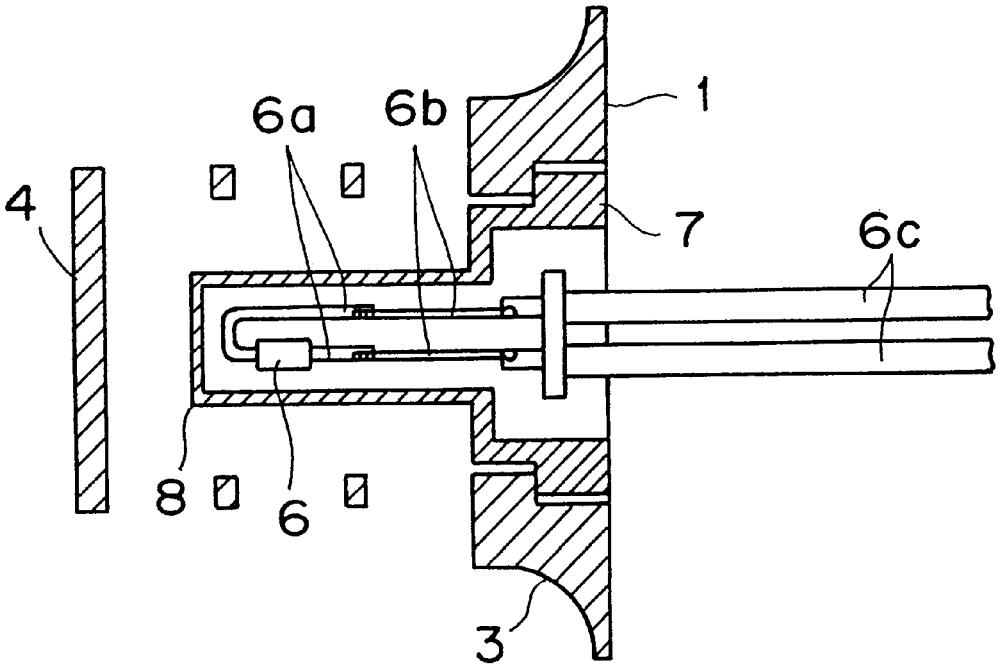
FIGS. 6A and 6B show yet another embodiment of the frost deposition detecting device in accordance with the present invention.

In the above embodiments, the heat insulating structure is preferably formed such that the edge of the thermally sensitive portion of the thermally sensitive element 6 disposed inside the protection pipe 8 is kept as distant as possible from the base member 1 so that the heat insulator 7 and the protection pipe 8 can prevent heat transmission from the base member 1 to the heat sensitive member 6. As an example of the improved heat insulating structure, FIG. 6(A) shows that a lead wire 6*b* made of iron or nichrome having less heat conductivity than the lead wire 6*a* of the thermally sensitive element 6 is attached to the lead wire 6*a* of the thermally sensitive element 6. Such heat insulating structure can be applied to any of the above embodiments.

Figure 6B:
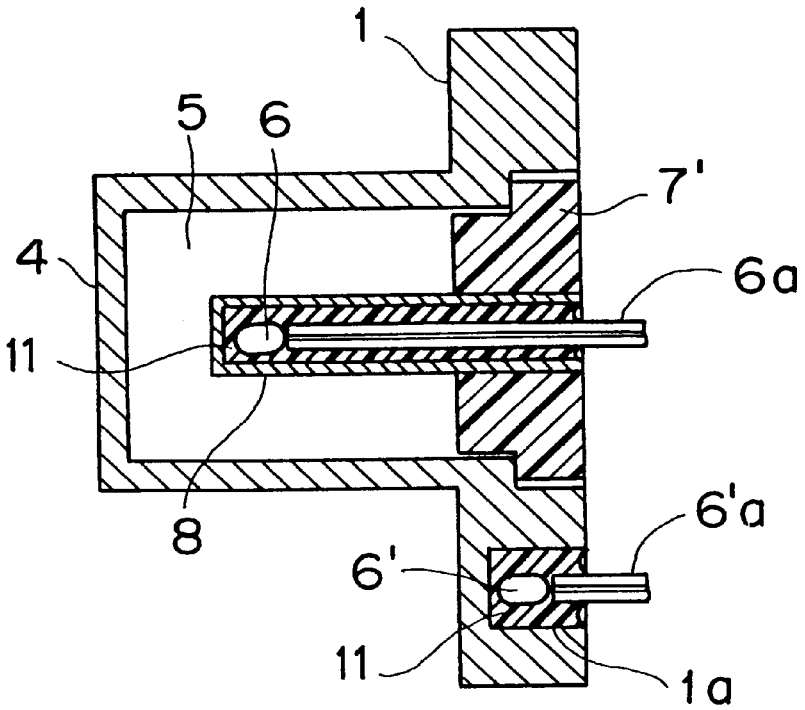

In FIG. 6(B), the protection pipe 8 is inserted into a heat insulator 7', and this structure may also be applied to the embodiments of FIGS. 1, 2, and 6(A).

In the embodiments described so far, the ambient temperature can be promptly detected if the edge of the protection pipe 8 is made of a metal having excellent heat conductivity. In this manner, the frost deposition detecting device can have better responsibility.

Furthermore, drops of water as a result of defrosting are liable to remain inside the containers and on the frosting portion, and at the time of re-cooling, they might freeze and block the openings area, resulting in inaccurate frost deposition detection. To solve such problem, the frosting portion is coated with a water repellent or hydrophilic material such as Teflon, silicon, and nylon, so that no drops of water will remain on the frosting portion, and that accurate frost deposition detection can be performed.

The inner surface of the frosting portion and the surface of the protection pipe may be coated with any of the above materials, and the entire surface of the frosting portion and the surface of the protection pipe may also be coated with them.

Figure 7:
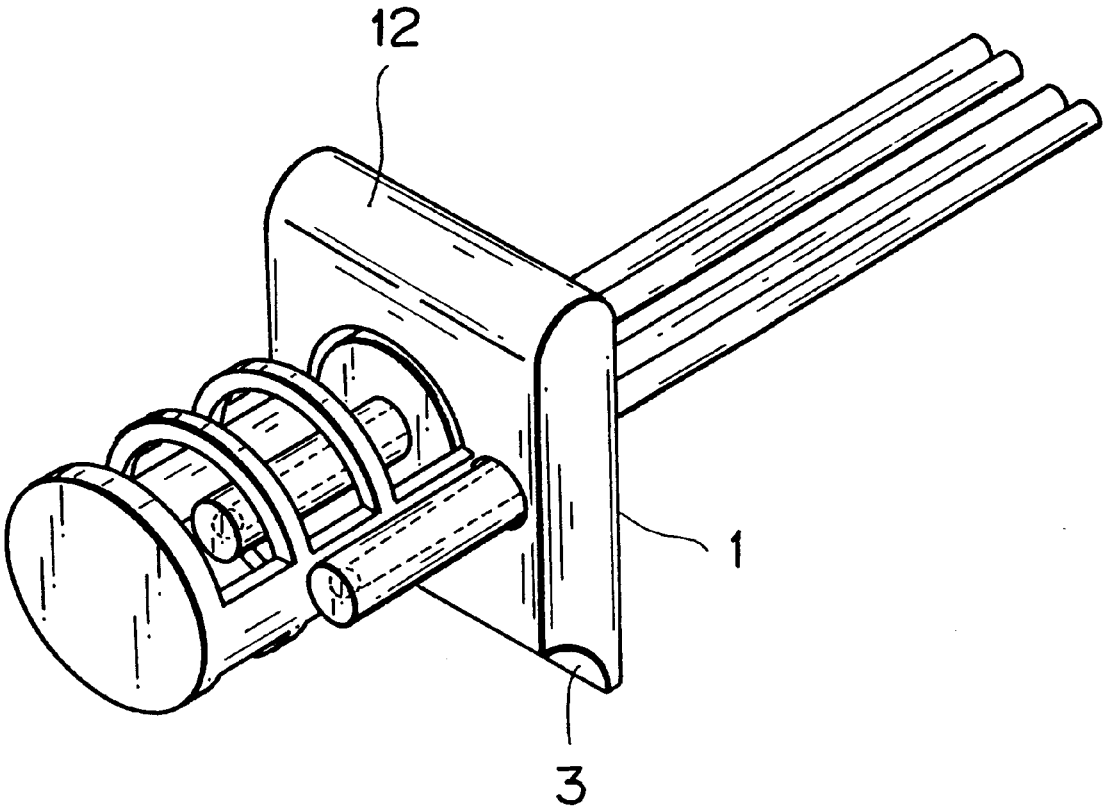
FIG. 7 shows still another embodiment of the frost deposition detecting device in accordance with the present invention.

In the embodiments described so far, the contact portion 3 provided to both sides of the base member 1 is brought into contact with both sides of the cooling pipe. However, the contact portion 3 may also be in contact with only one side of the cooling pipe, as shown in FIG. 7. A semi-circular surface 12 is formed on the side surface opposite from the contact portion 3 of the base member 1. The water produced at the time of defrosting runs down along the curved surface 12. Accordingly, no water remains on the base member 1, which eliminates the possibility of faulty operation at the time of re-frosting. The shape of the curved surface 12 is not limited to the semi-circular surface, and any shape may be taken as long as it has a slope along which the water runs down.

The curved surface 12 provided to the base member 1 shown in FIG. 7 may also be applied to any of the frost deposition detecting devices of FIGS. 1, 3, 5, and 6.

As described so far, the frost deposition detecting device of the present invention is provided with a thermally sensitive element covered with a protection pipe disposed inside a heat-conductive container having a frosting portion, and another thermally sensitive element for detecting the temperature of the base member. The protection pipe is heat-insulated by the heat insulator, which is heat-insulated from the base member. The thermally sensitive element disposed inside the heat-conductive container having the frosting portion detects the ambient temperature. If the frosting portion is frosted, the air inside the container is isolated from outside, and the inner temperature changes. Frosting is thus detected from the temperature difference between the base member and the inner temperature.

With the frost deposition detecting device of another embodiment of the present invention, a change in outside temperature caused by the blockage of the frosting portion is detected by the thermally sensitive element provided to the frosting portion including a pillar-like portion. The other thermally sensitive element disposed inside the cavity in the blocked container detects the ambient temperature around the evaporator. Thus, frosting can be detected from the temperature difference.

In the frost deposition detecting device of the present invention, the capacity of the cavity in the container on the frost deposition detecting side is substantially the same as that on the temperature compensation side. Accurate frost deposition detection can be performed by equalizing the heat capacities of both containers including temperature detecting portions.

Effects of the Invention

As described so far, with the frost deposition detecting device of the present invention, frost deposition detecting performance is dramatically improved, because the thermally sensitive elements enable accurate ambient temperature detection, the heat insulating structure consisting of the heat insulator and the protection pipe preventing heat transmission from the heat-conductive base member to the thermally sensitive elements. Since the structure is simple enough, assembling and maintenance are easy, and the production costs can be low. The use of the frost deposition detecting device of the present invention enables energy-efficient cooling operations by controlling the start and stop of defrosting so that defrosting is performed only when necessary.

Furthermore, the frost deposition detecting device of the present invention has a structure in which the heat-conductive container is supported by a part of the base member, so that at the time of defrosting, no water remains inside the container having the frosting portion, and wrong operations due to the frozen remaining water can be prevented at the time of re-cooling.

The thermally sensitive element is inserted into and secured in the protection pipe having the heat insulator, so that it is heat-insulated from the base member. Thus, heat conduction from the base member to the thermally sensitive element can be prevented.

Also, the protection pipe containing the thermally sensitive element improves reliability in water resistance or humidity resistance.

REFERENCE NUMERALS

1 base member
2 cooling pipe
3 contact portion
4 container
5 cavity
6, 6' thermally sensitive elements
6*a* lead wire (6*c*, 6'*a*)
7, 7' heat insulator
7*a* concave space
8, 8' protection pipe
9 frosting portion
10 pillar-like frosting portion
11 resin
12 curved surface

What is claimed is:

1. A frost deposition detecting device comprising:

a heat-conductive base member;

a first thermally sensitive element for detecting a temperature of said base member;

a frost receiving structure provided on said base member said frost receiving structure being adapted to have frost form thereon;

a protection pipe arranged with said base member so as to extend adjacent to said frost receiving structure;

a heat insulator arranged with said protection pipe to thermally isolate said protection pipe from said base member; and a second thermally sensitive element for detecting an ambient temperature of a region surrounding said frost receiving portion, said second thermally sensitive element being disposed in said protection pipe.

2. A frost deposition detecting device according to claim 1, wherein said base member and said frosting portion or a heat-conductive container having said frosting portion are made of aluminum, copper, iron, nickel, titanium, zinc, or an alloy of any combination of said materials.

3. A frost deposition detecting device according to any claim 1, wherein heat insulators are formed separately from said protection pipes.

4. A frost deposition detecting device according to claim 1, wherein at least said frosting portion is coated with a water repellent material or a hydrophilic material.

5. A frost deposition detecting device according to claim 1, wherein said base member has a contact portion with a pipe of an evaporator.

6. A frost deposition detecting device according to claim 5, wherein the contact portion is curved or inclined.

7. A frost deposition detecting device comprising:

a heat-conductive base member;

a first thermally sensitive element for detecting temperature of said base member;

a heat-conductive container including a frost collecting portion provided on said base member;

a protection pipe disposed through said base member and arranged to project into a cavity inside said heat-conductive container;

a heat insulator portion formed with said protection pipe to thermally isolate said protection pine from said base member; and a second thermally sensitive element for detecting the ambient temperature of a region surrounding said frost collection portion, said thermally sensitive element being disposed in said protection pipe.

8. A frost deposition detecting device comprising:

a heat-conductive base member;

a heat-conductive container including a frosting portion on which frost forms, provided on said base member;

a first cavity inside said heat-conductive container;

a second cavity formed adjacent to said heat-conductive container;

first and second protection pipes disposed in said respective cavities;

heat insulators respectively formed with said first and second protection pipes to thermally isolate the first and second protection pipes from said base member; and first and second thermally sensitive elements respectively disposed in said first and second protection pipes.

9. A frost deposition detecting device comprising:

a heat-conductive base member;

a first heat-conductive container having a frosting portion connected to said base member;

a second heat-conductive container connected to said base member;

first and second protection pipes respectively disposed in first and second cavities respectively formed within said first and second heat-conductive containers;

heat insulators formed with said first and second protection pipes to thermally isolate them from said base member; and first and second thermally sensitive elements respectively disposed in said first and second protection pipes.

10. A frost deposition detecting device comprising:

a heat-conductive base member;

a frosting portion comprising pillar-like protrusions disposed on said base member;

a heat-conductive container connected to said base member;

a first protection pipe disposed adjacent to said frosting portion;

a second protection pipe disposed in a cavity inside said heat-conductive container;

heat insulators formed with said first and second protection pipes to thermally isolate the first and second protective pipes from said base member; and first and second thermally sensitive elements respectively disposed in said first and second protection pipes.

* * * * *